US010706756B2

(12) United States Patent
Lin et al.

(10) Patent No.: US 10,706,756 B2
(45) Date of Patent: Jul. 7, 2020

(54) DISPLAY, DISPLAY DRIVING DEVICE, AND DRIVING METHOD THEREOF

(71) Applicant: AU OPTRONICS CORPORATION, Hsin-Chu (TW)

(72) Inventors: Ching-Chih Lin, Hsin-Chu (TW); Jie-Chuan Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/547,665

(22) Filed: Aug. 22, 2019

(65) Prior Publication Data

US 2020/0074902 A1 Mar. 5, 2020

(30) Foreign Application Priority Data

Sep. 4, 2018 (TW) ..... 107131031 A

(51) Int. Cl.
*G09G 3/00* (2006.01)

(52) U.S. Cl.
CPC ..... *G09G 3/006* (2013.01); *G09G 2310/0297* (2013.01)

(58) Field of Classification Search
CPC .... G09G 3/006; G09G 3/3614; G09G 3/3685; G09G 2310/0297
See application file for complete search history.

(56) References Cited

U.S. PATENT DOCUMENTS

2010/0259523 A1* 10/2010 Huang ..... G09G 3/3688 345/211
2014/0198021 A1* 7/2014 Tu ..... G09G 3/3688 345/87
2016/0104422 A1* 4/2016 Kishi ..... G09G 3/006 345/205
2016/0351142 A1* 12/2016 Ouyang ..... G09G 3/3614
2018/0211620 A1* 7/2018 Kurokawa ..... H01L 29/78648
2019/0265858 A1* 8/2019 Nishio ..... G09G 3/3648

FOREIGN PATENT DOCUMENTS

| | | |
|---|---|---|
| CN | 200410095422 | 7/2005 |
| CN | 200710135772 | 10/2008 |
| TW | 102114617 | 12/2013 |
| TW | 103138185 | 6/2015 |

* cited by examiner

*Primary Examiner* — Ryan A Lubit
(74) *Attorney, Agent, or Firm* — WPAT, PC

(57) ABSTRACT

A display driving device is provided. The display device includes a first data line, a first switch, a first storage unit, and a data output unit. The first switch is electrically connected between the first data line and the data output unit, and the data output unit is further electrically connected to the first storage unit. In a first closing period of the first switch, the data output unit outputs a first data signal to the first data line through the first switch, and the first storage unit stores the first data signal received from the data output unit. After the first closing period and before a second closing period of the first switch, the first storage unit charges the data output unit with the first data signal so that the data output unit and the first data line are at the voltage level.

10 Claims, 4 Drawing Sheets

DISPLAY, DISPLAY DRIVING DEVICE, AND DRIVING METHOD THEREOF

FIELD OF THE INVENTION

The present invention relates to a display, a driving device, and a driving method thereof, and in particular, to a display, a display driving device, and a driving method thereof that are capable of reducing noise.

BACKGROUND OF THE INVENTION

Among various consumer electronics, display technologies including display panels have been widely applied to mobile phones, notebook computers, tablet computers, and the like. In recent years, touch function begin to be integrated into all display panels, allowing users to directly tap and slide on a screen with fingers or styluses to control the electronic product.

However, when a display panel is driving a plurality of data lines with a plurality of pixel data of a picture, noise is easily generated during or between the transmission of these pixel data, and furthermore, excessive noise affects the touch function.

For example, data signals in the pixel data are provided by a data driving circuit, and can be alternately provided to different data lines through a demultiplexer. When the data driving circuit outputs the data signals to these data lines, charge sharing occurs due to different voltage levels during switching between different data lines if data signals are different from each other. Noise caused by charge sharing often leads to malfunction of touch operation. Therefore, to propose a driving method capable of reducing panel noise is one of the main issues in the technical field.

SUMMARY

A display driving device and a driving method thereof of the present invention can reduce noise generated during the driving of a display panel.

The display driving device of the present invention includes a first data line, a first switch, a first storage unit, and a data output unit. The first switch is electrically connected between the first data line and the data output unit, and the data output unit is further electrically connected to the first storage unit.

In a first closing period of the first switch, the data output unit outputs a first data signal to the first data line through the first switch, and the first storage unit stores the first data signal received from the data output unit.

After the first closing period and before a second closing period of the first switch, the first storage unit charges the data output unit with the first data signal so that the data output unit and the first data line are at the same voltage level.

The driving method of the present invention is applicable to the foregoing driving device, and the driving method includes:

in the first closing period of the first switch, outputting, by the data output unit, the first data signal to the first data line through the first switch, and outputting the first data signal to the first storage unit;

in the second closing period of the first switch, outputting, by the data output unit, a third data signal to the first data line through the first switch, and outputting the third data signal to the first storage unit; and before the step of outputting the third signal, charging, by the first storage unit, the data output unit with the first data signal so that the data output unit and the first data line are at the same voltage level.

A display of the present invention includes a data driver, a plurality of data lines, a multiplexing unit, a data output unit, and a plurality of storage units. An output pin of the data driver is configured to output a data signal, and the data output unit and the multiplexing unit are connected between the data driver and the data lines. The data output unit is electrically connected between the multiplexing unit and the data driver, and the data output unit outputs the data signal from the data driver to the multiplexing unit. The multiplexing unit includes a plurality of first switches, each first switch including a first input end, a first output end, and a first control end, the first output end being connected to a data line.

The first control ends of these first switches connect the first input end and the first output end according to a selection signal, and the data output unit outputs, the data signal from the data driver through the first switch to the data line to which the closed first switch is connected.

Each storage unit is electrically connected to the data output unit, and is connected to one of the first switches. The storage unit includes a second switch, a third switch, and a capacitor. The second switch including a second input end, a second output end, and a second control end. The second input end is electrically connected to the data output unit and the first switch. The selection signal for closing the first switch also serves to close the second switch through the second control end. The third switch includes a third input end, a third output end, and a third control end. The third input end is electrically connected to the second output end of the second switch, and the third output end is electrically connected to the data output unit. The third control end electrically connects the third input end and the third output end according to a horizontal enable signal. The capacitor is electrically connected to the second output end and the third input end.

When the second switch is closed according to the selection signal, the capacitor stores the data signal; when the third switch is closed according to the horizontal enable signal, the capacitor charges the data output unit.

As described above, the display driving device and the driving method thereof of the present invention can be used to store a data signal transmitted to a data line using the storage unit, and charge the data output unit with the stored data signal when the signal is to be transmitted to the same data line next time. Noise is reduced by reducing the voltage level difference between elements. A display including the display driving device of the present invention also has low noise.

In order to further the understanding of the present disclosure, reference is made to the following detailed description illustrating the embodiments and examples of the present disclosure. The description is for illustrative purpose only and is not intended to limit the scope of the claim.

DETAILED DESCRIPTION OF EMBODIMENTS

A display driving device and a driving method provided in the present invention can be applied to a liquid crystal display (LCD). Preferably, the display driving device and the driving method provided in the present invention can be applied to a multiplexer (MUX) driven LCD.

Figure 1:
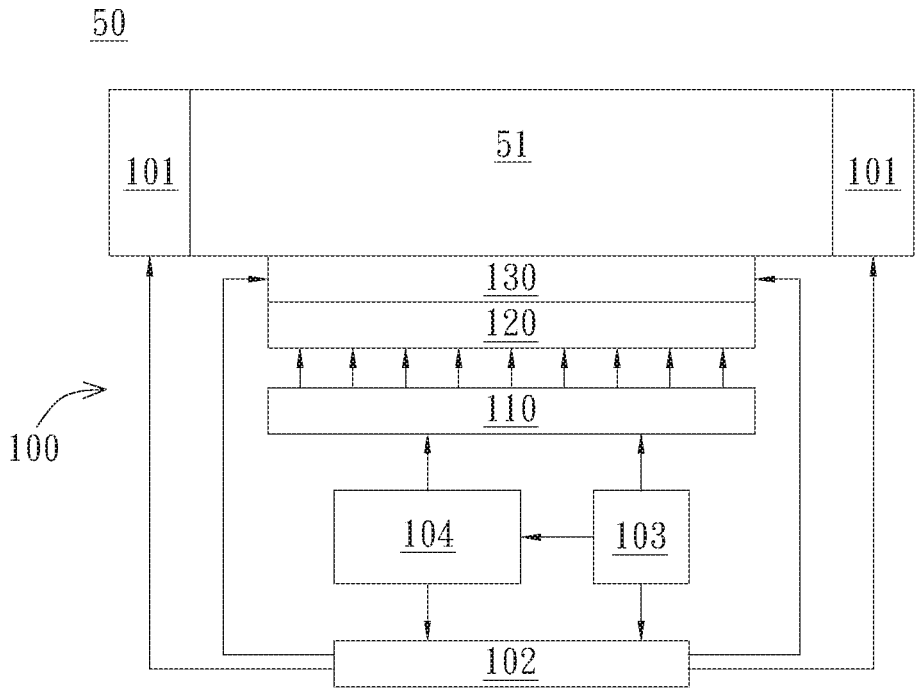
FIG. 1 is a functional diagram illustrating a display according to a first embodiment of the present invention.

Referring to FIG. 1, a display 50 according to a first embodiment of the present invention includes a display panel 51 and a driving device 100. In this embodiment, the display device 50 is an LCD, and the display panel 51 is a liquid crystal panel. The driving device 100 includes a driving control circuit 102, a scan control circuit (Scan driver) 101, a multiplexing unit 130, an output storage circuit 120, a data driving circuit (Data driver) 110, a timing control circuit 104 (timing controller, T con), and a voltage source conversion circuit 103.

The display panel 51 includes a plurality of pixel electrodes, a plurality of scan lines and a plurality of data lines (not shown) connected to the pixel electrodes. The scan control circuit 101 is connected to these scan lines to output scan signals, and the data driving circuit 110 is connected to these data lines through the output storage circuit 120 and the multiplexing unit 130 to output data signals. The timing control circuit 104 converts a video signal provided to the display 50 into a data signal for the data driving circuit 110, and controls the time for driving the data line of the display panel 51. The voltage source conversion circuit 103 generates a voltage source required for each circuit from an external power source. The above is merely exemplified to illustrate the technical features of the present invention, but the present invention is not limited to the foregoing layout. A person skilled in the art can replace the aforementioned components according to actual needs to achieve the same function. Detailed features of the driving device 100 proposed in the present invention is further described below with reference to specific drawings, and in order to describe the detailed features and the connections, some components are omitted in the drawings, which are not intended to limit the present invention.

It should be understood that, although terms such as "first," "second," and "third," are used in the following description to describe various components; however, these components should not be limited by these terms. These terms are merely used to distinguish one component from another. Therefore, "first component", for example, can also be referred to as "second component" without departing from the teachings herein.

Figure 2:
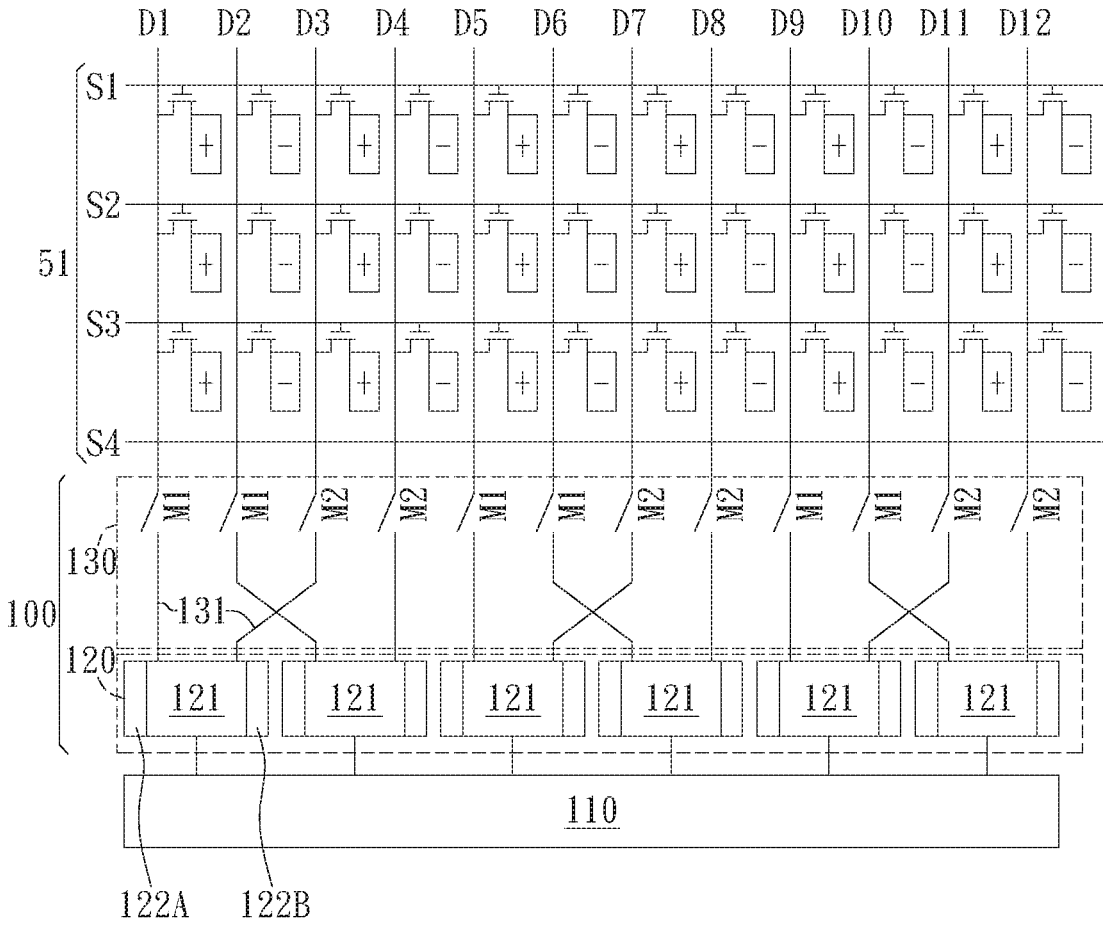
FIG. 2 is a schematic circuit diagram of a display panel and a driving device according to a first embodiment of the present invention.

Referring to FIG. 2, the display panel 51 has a plurality of scan lines S1-S4 and data lines D1-D12. The data driving circuit 110 includes an output pin (not shown), and the data signal is outputted via the output pin through the output storage circuit 120 and the multiplexing unit 130 to the data lines D1-D12. The driving device 100 connected to the data line D1 is used as an example. The driving device 100 includes a first switch M1, a data output unit 121, and a first storage unit 122A. When the first switch M1 is closed during a first closing period, the data driving circuit 110 outputs a data signal to the data line D1 through the data output unit 121, and the storage unit 122A receives the data signal from the data driving circuit 110 and stores the data signal. After the first closing period, the storage unit 122A stores the voltage level of the data line D1.

The storage unit 122A of this embodiment enables the voltage level of the data output unit 121 to return to the voltage level of the data line D1 during the first closing period when the data driving circuit 110 provides a data signal to the data line D1 next time. When the data driving circuit 110 is to provide the data signal to the data line D1 again after the first closing period of the first switch M1, the first switch M1 is closed during a second closing period. Before the second closing period, the first storage unit 122A charges the data output unit 121 with the data signal during the first closing period so that the voltage level of the data output unit 121 is at the same voltage level with the data line D1. In this way, charge sharing is avoided or reduced when the first switch M1 is closed during the second closing period. The first switch M1 may be a transistor, and the connection between the data line D1 and the data output unit 121 is controlled a gate signal.

For the data line D3 that also receives, the data signal from the data driving circuit 110 through the foregoing data output unit 121 and the second switch M2, a storage unit 122B of the driving device 100 can store the data signal thereof so that the next time a data signal is outputted to the data line D3, the data output unit 121 may be charged by the storage unit 122B in a manner such that the voltage level of the data line D3 is the same as the voltage level of the data output unit 121. The second switch M2 may be a transistor, and the connection between the data line D3 and the data output unit 121 is controlled via a gate signal.

When the driving device 100 of this embodiment provides data signals to the data lines D1 and D3 through the data output unit 121, with the storage units 122A and 122B, the first switch M1 is closed when the data line D1 and the data output unit 121 are at the same voltage level, and the second switch M2 is closed when the data line D3 and the data output unit 121 are at the same voltage level, thereby reducing or even avoiding charge sharing.

For example, when the first switch M1 and the second switch M2 are provided by the demultiplexer 131 in the multiplexing unit 130, when the data driving circuit 110 sequentially allocates data signals to the data lines D1 and D3 through the demultiplexer 131, the storage unit 122A stores the voltage level of the data line D1 after the data line D1 receives the data signal, and the storage unit 122B stores the voltage level of the data line D3 after the data line D3 receives the data signal. Before the demultiplexer 131 switches between the data lines D1 and D3, the voltage level of the data output unit 121 can be charged by the storage unit 122A before a data signal is to be transmitted to the data line D1 next time, and charged by the storage unit 122B before a data signal is to be transmitted to the data line D3 next time, so that when the first switch M1 or the second switch M2 is closed, the voltage level of the data output unit 121 can be the same as the voltage level of the data line D1 or the data line D3.

This embodiment is exemplified using demultiplexers 131 of two data output ends, but the present invention is not limited to the setting of the multiplexer or the demultiplexer in the multiplexing unit 130, nor is it limited to a number of input ends or output ends in these assemblies. A person with ordinary skill in the technical field of the present invention may reduce noise generated by the multiplexing unit 130 during switching of these data lines D1 to D12 using the technical solutions proposed by the present invention.

Figure 3:
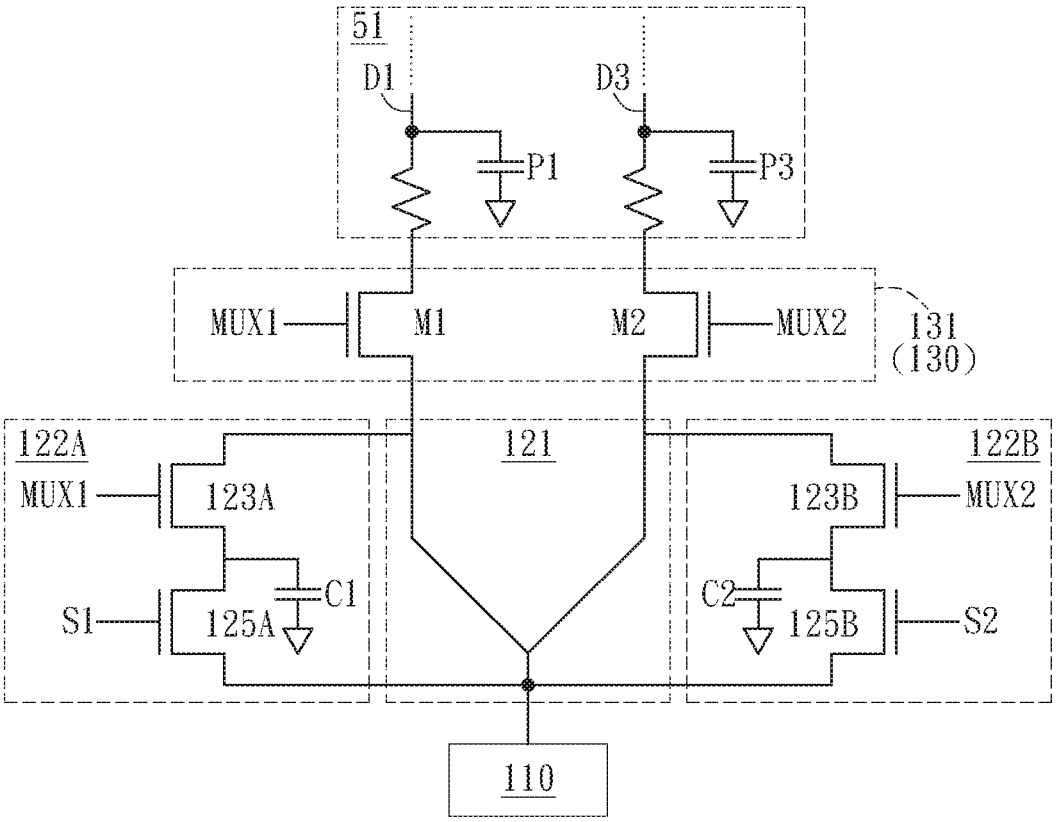
FIG. 3 is a schematic circuit diagram of a driving device according to a first embodiment of the present invention.

In particular, referring to FIG. 3, the storage unit 122A of this embodiment includes a third switch 123A, a first capacitor C1, and a fourth switch 125A. The third switch 123A is connected to the fourth switch 125A, and the first capacitor C1 is connected to a point where the third switch 123A and the fourth switch 125A are connected to each other.

In this embodiment, the first switch M1 is enabled during the first closing period, so that the data signal can be transmitted to the data line D1 and a display capacitor P1. During the first closing period in which the first switch M1 is closed, the third switch 123A is also switched on. During this period, the first capacitor C1 can store the data signal from the data driving circuit 110 through the third switch 123A. After the first closing period ends, the data signal stored in the first capacitor C1 includes the voltage level of the data line D1 and the data output unit 121 during the first closing period.

After the first switch M1 is disabled, the data output unit 121 provides another data signal to the data line D3, wherein the voltage level of the data signal provided to the data line D3 is different from that of the data signal provided to the data line D1. After the data signal is provided to the data line D3, the fourth switch 125A is switched on before the first switch M1 is closed again, so that the data output unit 121 can be charged with the voltage level during the first closing period using the first capacitor C1, and the voltage level of the data output unit 121 when the first switch M1 is closed again during the second closing period can be the same as the voltage level of the data line D1.

In another aspect, the second storage unit 122B of this embodiment includes a fifth switch 123B, a second capacitor C2, and a sixth switch 125B. The fifth switch 123B is connected to the sixth switch 125B, and the second capacitor C2 is connected to a point at which the fifth switch 123B and the sixth switch 125B are connected to each other.

In this embodiment, the second switch M2 is enabled during the second closing period, so that the data signal can be transmitted to the data line D3 and a display capacitor P3. After the first closing period of the first switch M1, the sixth switch 125B is first switched on before the second switch M2 is closed, so that the second capacitor C2 charges the data output unit 121 with a data signal stored last time, and the voltage level of the data output unit 121 is the same as that of the data line D3 when the second switch M2 is closed.

When the second switch M2 is closed, the fifth switch 123B is also switched on, and the data signal that is outputted from the data driving circuit 110 can be transmitted to the data line D3 and the second capacitor C2. The second capacitor C2 receives the data signal through the fifth switch 123B during a closing period of the second switch M2, and the second capacitor C2 stores the data signal, so that the fifth switch 123B and the sixth switch 125B can maintain at the same voltage level same as that of the data line D3.

After the second switch M2 is disabled, the voltage level of the data output unit 121 after the second closing period of the first switch M1 is the same as the voltage level of the data line D1, but is different from the voltage level of the data line D3. The second capacitor C2 charges the data output unit 121 by switching on the sixth switch 125B, so that the voltage level of the data output unit 121 returns to the same as that of the data line D3.

The driving method for the driving device of the present invention is further described below from the perspective of driving signals. Referring first to FIG. 3, the first switch M1 and the third switch 123A are controlled using a signal MUX1, the second switch M2 and the fifth switch 123B are controlled using a signal MUX2, the fourth switch 125A is controlled using a horizontal enable signal S1, and the sixth switch 125B is controlled using horizontal enable signal S2.

Figure 4:
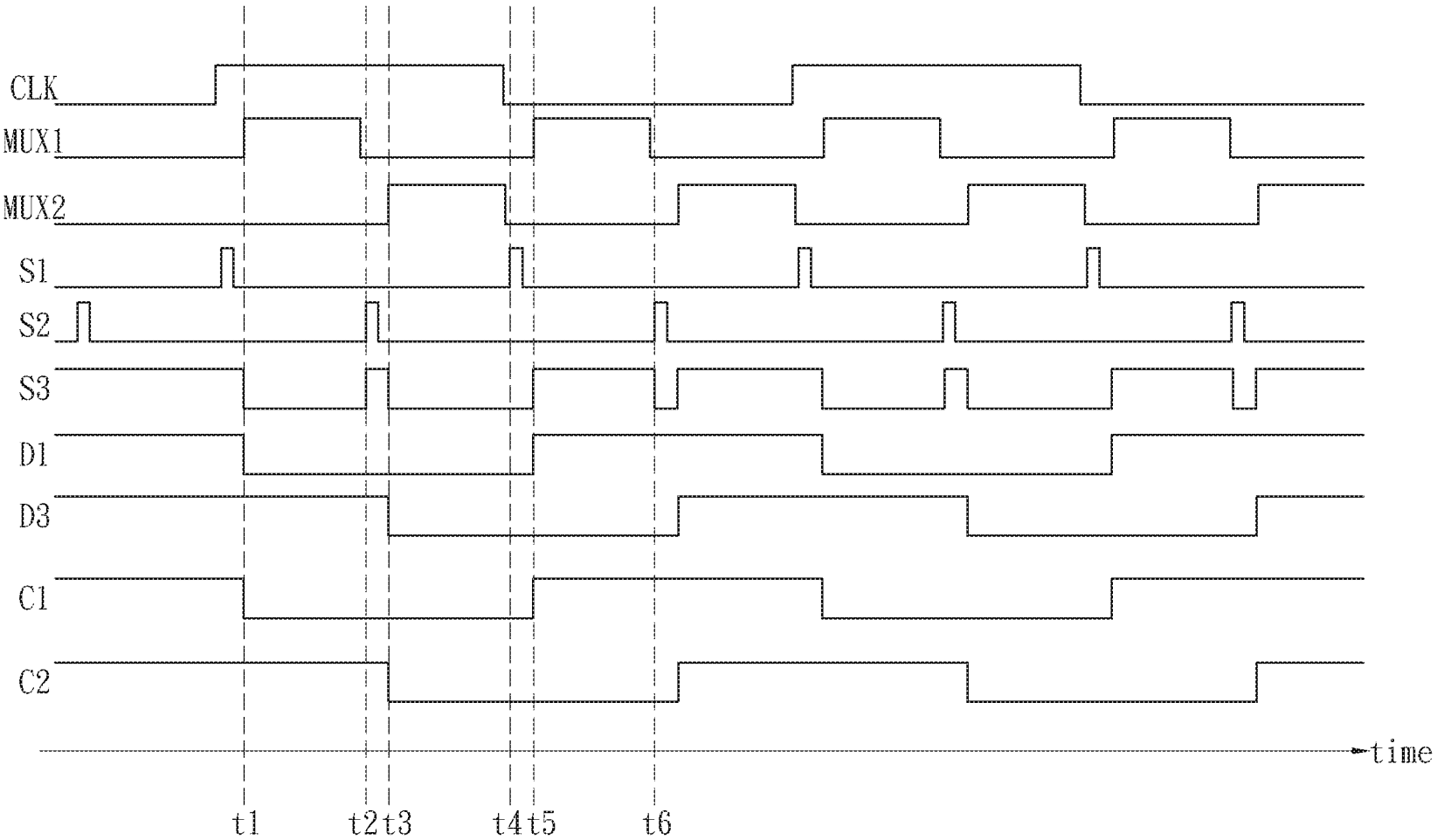
FIG. 4 is a schematic signal diagram of a driving device according to a first embodiment of the present invention.

Referring to FIG. 4, the signals MUX1 and MUX2 are used to sequentially close the foregoing switches M1 and 123A and the switches M2 and 123B in one cycle of a timing signal CLK. The first closing period of the first switch M1 starts, at time t1. At this time, with the output of the data signal, the voltage level (signal S3) of the data output unit 121 changes the voltage level of the data line D1 and a voltage level of the first capacitor C1. After the first closing period ends and before a time t3 of the second switch M2 starts, the sixth switch 125B is switched on at time t2 so that the second capacitor C2 can charge the data output unit 121, thereby enabling the voltage level (signal S3) of the data output unit 121 to be the same as the voltage level of the second capacitor C2.

After the second switch M2 is closed by the signal MUX2, signal S1 switches on the fourth switch 125A at time t4, so that the voltage level (the signal S3) of the data output unit 121 is again the same as the voltage level of the first capacitor C1. The voltage levels (signal S3) of the data output unit 121 after time t4 and after time t1 are the same, and are also the same as the voltage level of the data line D1.

After the first switch M1 is closed by the signal MUX1, the signal S2 is switches on the sixth switch 125B at time t6, so that the voltage level (signal S3) of the data output unit 121 is again the same as the voltage level of the second capacitor C2. The voltage levels (signal S3) of the data output unit 121 after the time t6 and after the time t3 are the same, and are also the same as the voltage level of the data line D3.

In summary, in the driving method for the display driving device proposed in the present invention, during each driving of a data line, with the help of the first storage unit, the data output unit can return to a voltage level before outputting a data signal to a data line, wherein the voltage level is that of the data output unit and the data line after the last time the data output unit outputs a data signal to the data line, so that both the data output unit and the data line can start receiving a data signal at the same voltage level, thereby reducing charge sharing to reduce noise. Since the driving device included in the display device proposed in the present invention includes the first storage unit, the voltage level at which each time the data line of the display panel in the display receives a data signal is the same as the voltage level of the data output unit of the driving device, so that overall noise can be reduced.

The descriptions illustrated supra set forth simply the embodiments of the instant disclosure; however, the characteristics of the instant disclosure are by no means restricted thereto. All changes, alterations, or modifications conveniently considered by those skilled in the art are deemed to be encompassed within the scope of the instant disclosure delineated by the following claims.

What is claimed is:

1. A display driving device connected to a first data line of a display panel, the driving device comprising:
- a first switch electrically connected to the first data line;
- a first storage unit; and
- a data output unit electrically connected to the first switch and the first storage unit,
- wherein when the first switch is in a first closing period, the data output unit outputs a first data signal to the first data line through the first switch, and the first storage unit stores the first data signal received from the data output unit; and when the first switch is in a period after the first closing period and before a second closing period, the first storage unit outputs the first data signal to the data output unit so that the data output unit and the first data line are at the same voltage level.

2. The display driving device according to claim 1, the driving device being further connected to a second data line of the display panel, and the driving device further comprising:

a second switch electrically connected to the second data line; and a second storage unit, the data output unit being electrically connected to the second switch and the second storage unit, wherein when the second switch is in a third closing period, and the third closing period is between the first closing period and the second closing period of the first switch, the data output unit outputs a second data signal to the second data line through the second switch, and the second storage unit stores the second data signal received from the data output unit; and when the second switch is in a period after the third closing period and before a fourth closing period, and the fourth closing period is after the second closing period of the second switch, the second storage unit charges the data output unit with the second data signal so that the data output unit and the second data line output the same voltage level.

3. The display driving device according to claim 2, wherein the second storage unit includes a fifth switch, a sixth switch, and a second capacitor coupled therebetween, the fifth switch being electrically connected to the second switch, and the sixth switch being electrically connected to the data output unit.

4. The display driving device according to claim 3, wherein the fifth switch is closed during the third closing period and the fourth closing period of the second switch, and the second capacitor receives the second data signal through the fifth switch and stores the second data signal; and the sixth switch is closed before the fourth closing period, and the data output unit outputs the second data signal through the sixth switch.

5. The display driving device according to claim 1, wherein the first storage unit includes a third switch, a fourth switch, and a first capacitor coupled therebetween, the third switch being electrically connected to the first switch, and the fourth switch being electrically connected to the data output unit.

6. The display driving device according to claim 5, wherein the third switch is closed during the first closing period and the second closing period of the first switch, and the first capacitor receives the first data signal through the third switch and stores the first data signal, and the fourth switch is closed before the second closing period, and the data output unit outputs the first data signal through the fourth switch.

7. The display driving device according to claim 2, further comprising a multiplexing unit, the multiplexing unit including the first switch and the second switch.

8. A display driving method applicable to a driving device connected to a first data line of a display panel, the driving device including a first switch electrically connected to the first data line, a first storage unit, and a data output unit electrically connected to the first switch and the first storage unit, the display driving method comprising the following steps:

a. when the first switch is in the first closing period, outputting, by the data output unit, the first data signal to the first data line through the first switch, and outputting the first data signal to the first storage unit; and b. when the first switch is in the second closing period, outputting, by the data output unit, a third data signal to the first data line through the first switch, and outputting the third data signal to the first storage unit; wherein before step b, the first storage unit charges the data output unit with the first data signal so that the data output unit and the first data line are at the same voltage level.

9. The display driving method according to claim 8, wherein the driving device further includes a second data line, a second switch electrically connected to the second data line, and a second storage unit, the data output unit being electrically connected to the second switch and the second storage unit, and the display driving method further comprising the following step between step a and step b:

c. when the second switch is in a third closing period, outputting, by the data output unit, a second data signal to the second data line and the second storage unit through the second switch; and d. when the second switch is in a fourth closing period, outputting, by the data output unit, a fourth data signal to the second data line and the second storage unit through the second switch; wherein before step d, the second storage unit charges the data output unit with the second data signal so that the data output unit and the second data line are at the same voltage level.

10. A display, comprising:

a data driver having an output pin for outputting a data signal;

a plurality of data lines;

a multiplexing unit including a plurality of first switches, each of the first switches having a first input end, a first output end, and a first control end, the first output end being connected to one of the data lines, and each of the first switches electrically connecting the first input end and the first output end when the first control terminal receives a selection signal;

a data output unit electrically connected between the first input ends of the multiplexing unit and the data driver, the data output unit outputting, the data signal from the data driver to the multiplexing unit, and the data signal being outputted to the data line through the closed first switch of the multiplexing unit;

a plurality of storage units electrically connected to the data output unit, each of the storage units being connected to one of the first switches, and each of the storage units including:

a second switch, including a second input end, a second output end, and a second control end, the second input end being electrically connected to the data output unit and the first input end of the first switch to which the storage unit is connected, the second control end and the first control end of the first switch receiving the selection signal simultaneously, and electrically connecting the second input end and the second output end;

a third switch, including a third input end, a third output end, and a third control end, the third input end being electrically connected to the second output end, the third output end being electrically connected to the data output unit, and the third control end electrically connecting the third input end and the third output end according to a horizontal enable signal; and a capacitor electrically connected to the second output end and the third input end, the capacitor storing the data signal when the second switch is closed, and outputting the data signal to the data output unit when the third switch is closed.

* * * * *